US010443869B2

(12) United States Patent
Kawano et al.

(10) Patent No.: US 10,443,869 B2
(45) Date of Patent: Oct. 15, 2019

(54) AIR CONDITIONER CONSTRUCTION METHOD

(71) Applicant: DAIKIN INDUSTRIES, LTD., Osaka-shi, Osaka (JP)

(72) Inventors: Satoshi Kawano, Osaka (JP); Shinya Matsuoka, Osaka (JP); Masahiro Oka, Osaka (JP); Mari Susaki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 193 days.

(21) Appl. No.: 15/625,328

(22) Filed: Jun. 16, 2017

(65) Prior Publication Data

US 2017/0284686 A1 Oct. 5, 2017

Related U.S. Application Data

(62) Division of application No. 14/649,417, filed as application No. PCT/JP2013/007041 on Nov. 29, 2013, now Pat. No. 10,184,676.

(30) Foreign Application Priority Data

Dec. 28, 2012 (JP) ..... 2012-288287

(51) Int. Cl.
*F24F 5/00* (2006.01)
*F25B 30/02* (2006.01)
(Continued)

(52) U.S. Cl.
CPC ..... *F24F 5/001* (2013.01); *F24F 3/08* (2013.01); *F25B 13/00* (2013.01); *F25B 30/02* (2013.01);
(Continued)

(58) Field of Classification Search
CPC .... F25B 30/02; F24F 5/001; F24F 2313/0231
See application file for complete search history.

(56) References Cited

U.S. PATENT DOCUMENTS

2003/0230100 A1 12/2003 Hwang
2003/0230107 A1* 12/2003 Lee ..... F25B 13/00 62/324.6
2007/0245752 A1 10/2007 Honda

FOREIGN PATENT DOCUMENTS

CN 1483970 A 3/2004
JP 2004-278888 A 10/2004
(Continued)

*Primary Examiner* — David J Teitelbaum
(74) *Attorney, Agent, or Firm* — Birch, Stewart, Kolasch & Birch, LLP

(57) ABSTRACT

Operation switching units, each changing directions of a refrigerant flowing through its associated indoor unit in response to a switch from a cooling operation to a heating operation, or vice versa, are each connected with the associated indoor unit through indoor communication pipes; a gas-liquid separation unit is connected with an outdoor unit through outdoor communication pipes; and the operation switching units are connected with the gas-liquid separation unit through two intermediate communication pipes preinstalled and one intermediate communication pipe newly installed. This provides a simple and cost-effective means for upgrading a preinstalled air conditioner making a switch from cooling to heating, and vice versa, into an air conditioner that can perform a cooling operation and a heating operation in parallel with each other.

2 Claims, 10 Drawing Sheets

(51) Int. Cl.
*F24F 3/08* (2006.01)
*F25B 13/00* (2006.01)

(52) U.S. Cl.
CPC . *F25B 2313/007* (2013.01); *F25B 2313/0231* (2013.01); *F25B 2313/0233* (2013.01); *F25B 2313/0272* (2013.01); *F25B 2313/02791* (2013.01)

(56) References Cited

FOREIGN PATENT DOCUMENTS

| | | | |
|---|---|---|---|
| JP | 2004-309088 | A | 11/2004 |
| JP | 2006-17374 | A | 1/2006 |
| JP | 2006-258342 | A | 9/2006 |
| JP | 2007-64510 | A | 3/2007 |
| JP | 2010-85071 | A | 4/2010 |
| WO | WO 2006/003925 | A1 | 1/2006 |

* cited by examiner

AIR CONDITIONER CONSTRUCTION METHOD

CROSS-REFERENCE TO RELATED APPLICATIONS

This application is a Divisional of copending U.S. patent application Ser. No. 14/649,417, filed on Jun. 3, 2015, which is a National Phase of International Patent Application No. PCT/JP2013/007041, filed on Nov. 29, 2013, which claims the benefit of Japanese Patent Application No. 2012-288287, filed on Dec. 28, 2012. The entire contents of which are hereby incorporated by reference.

TECHNICAL FIELD

The present invention relates to an air conditioner configured to perform a cooling operation and a heating operation in parallel with each other, and a reinstallation method for upgrading a preinstalled indoor-multi-type air conditioner that performs either a cooling operation or a heating operation just selectively, not in parallel with each other, to the air conditioner that is able to perform a cooling operation and a heating operation in parallel with each other.

BACKGROUND ART

A so-called "cooling/heating free type air conditioner," which is an indoor-multi-type air conditioner that includes a plurality of indoor units connected in parallel with an outdoor unit and is able to perform a cooling operation and a heating operation in parallel with each other, has been known (see, e.g., Patent Document 1). Patent Document 1 discloses upgrading a preinstalled indoor-multi-type air conditioner that performs either a cooling operation or a heating operation just selectively, not in parallel with each other, to the cooling/heating free type air conditioner.

The air conditioner of Patent Document 1 is configured by upgrading an air conditioner (1A) in which an outdoor unit (2) is connected with a plurality of indoor units (3) through two communication pipes (11, 12, 13, 14) to make a switch from cooling to heating, and vice versa, as illustrated in FIG. 3 into an air conditioner including a cooling/heating switching unit (6) so that the indoor units (3) are connected in parallel with the cooling/heating switching unit (6) as illustrated in FIG. 5. In this configuration, the cooling/heating switching unit (6) changes flow directions of refrigerants for the indoor units (3) so that a cooling operation and a heating operation can be performed in parallel with each other.

CITATION LIST

Patent Document

PATENT DOCUMENT 1: Japanese Unexamined Patent Publication No. 2004-309088

SUMMARY OF THE INVENTION

Technical Problem

However, in the air conditioner of FIG. 5, preinstalled pipes can be used as the communication pipes (11, 12) indicated by (A) and arranged between the outdoor unit (2) and the cooling/heating switching unit (6), whereas the preinstalled pipes cannot be used in most cases as the communication pipes (13, 14) indicated by (B) and arranged between the cooling/heating switching unit (6) and the indoor units (3). Consequently, new communication pipes are required. This makes the reinstallation process of the air conditioner of Patent Document 1 a major one, and also causes an increase in overall cost.

In view of the foregoing background, it is therefore an object of the present invention to provide a simple and cost-effective means for upgrading a preinstalled air conditioner configured to make a switch from cooling to heating, and vice versa, into an air conditioner that is able to perform a cooling operation and a heating operation in parallel with each other.

Solution to the Problem

A first aspect of the present invention is directed to an air conditioner including a refrigerant circuit (20) that includes an outdoor unit (2) and a plurality of indoor units (3) and is able to perform a refrigeration cycle in which a cooling operation and a heating operation are performed in parallel with each other.

This air conditioner includes a plurality of operation switching units (5), each of which is connected to an associated one of the indoor units (3) through two indoor communication pipes (13, 14) and changes directions of refrigerants flowing through the indoor communication pipes (13, 14) in response to a switch made by the indoor unit (3) from a cooling operation into a heating operation, and vice versa. The air conditioner also includes a gas-liquid separation unit (4) with which the operation switching units (5) are connected in parallel with each other through three intermediate communication pipes (15, 16, 17) comprised of two gas pipes and one liquid pipe, which is connected with the outdoor unit (2) through two outdoor communication pipes (11, 12), and which is provided separately from the operation switching units (5). The operation switching units (5) each include a flow channel switching circuit (65) that switches flow channels of a liquid refrigerant and a gas refrigerant between the intermediate communication pipes (15, 16, 17) and the indoor communication pipes (13, 14). The gas-liquid separation unit (4) includes a gas-liquid separator (41) and a refrigerant flow channel switching circuit (42) that switches flows of a liquid refrigerant and a gas refrigerant in the intermediate communication pipes (15, 16, 17).

A second aspect of the present invention is an embodiment of the first aspect of the present invention. In the second aspect, a refrigerant in the refrigerant circuit (20) is difluoromethane.

A third aspect of the present invention is directed to an air conditioner configured by upgrading an air conditioner in which an outdoor unit (2) and a plurality of indoor units (3) are connected together through a first communication pipe (11) and a second communication pipe (12) to perform a cooling/heating switchable refrigeration cycle into an air conditioner including a refrigerant circuit (20) that is able to perform a refrigeration cycle in which a cooling operation and a heating operation are performed in parallel with each other.

This air conditioner includes a plurality of operation switching units (5), each of which is connected to an associated one of the indoor units (3) through two indoor communication pipes (13, 14) and changes directions of refrigerants flowing through the indoor communication pipes (13, 14) in response to a switch made by the indoor unit (3) from a cooling operation into a heating operation, and vice versa. The air conditioner also includes a gas-liquid separation unit (4) with which the operation switching units (5) are connected in parallel with each other through three intermediate communication pipes (15, 16, 17) comprised of two gas pipes and one liquid pipe, which is connected with the outdoor unit (2) through two outdoor communication pipes (11, 12), and which is provided separately from the operation switching units (5). The operation switching units (5) each include a flow channel switching circuit (65) that switches flow channels of a liquid refrigerant and a gas refrigerant between the intermediate communication pipes (15, 16, 17) and the indoor communication pipes (13, 14). The gas-liquid separation unit (4) includes a gas-liquid separator (41) and a refrigerant flow channel switching circuit (42) that switches flows of a liquid refrigerant and a gas refrigerant in the intermediate communication pipes (15, 16, 17).

A fourth aspect of the present invention is an embodiment of the third aspect of the present invention. In the fourth aspect, one of the three intermediate communication pipes (15, 16, 17) is a gas pipe (17) that is newly installed at the time of that upgrading.

A fifth aspect of the present invention is an embodiment of the third or fourth aspect of the present invention. In the fifth aspect, a refrigerant in the refrigerant circuit (20) after that upgrading is difluoromethane.

A sixth aspect of the present invention is directed to a reinstallation method for upgrading an air conditioner including a refrigerant circuit that includes an outdoor unit (2) and a plurality of indoor units (3) to perform a cooling/heating switchable refrigeration cycle to an air conditioner including a refrigerant circuit (20) that is able to perform a refrigeration cycle in which a cooling operation and a heating operation are performed in parallel with each other.

This reinstallation method for an air conditioner includes an operation switching unit connecting step to connect each of the operation switching units (5), which changes the directions of a refrigerant flowing through its associated indoor unit (3) in response to a switch from a cooling operation to a heating operation, or vice versa, with the associated indoor unit (3) through two indoor communication pipes (13, 14) that form parts of preinstalled communication piping. The reinstallation method also includes a gas-liquid separation unit connecting step to connect the gas-liquid separation unit (4), which is disposed separately from the operation switching units (5) and includes a gas-liquid separator (41) and a refrigerant flow channel switching circuit (42) that switches flows of a liquid refrigerant and a gas refrigerant, with the outdoor unit (2) through two outdoor communication pipes (11, 12) that form other parts of the preinstalled communication piping. The method further includes a pipe connecting step to connect the operation switching units (5) with the gas-liquid separation unit (4) in parallel with each other through two intermediate communication pipes (15, 16) that form other parts of the preinstalled communication piping and one intermediate communication pipe (17) newly installed.

A seventh aspect of the present invention is an embodiment of the sixth aspect of the present invention. In the seventh aspect, the reinstallation method includes a step to fill the refrigerant circuit (20) of the upgraded air conditioner with difluoromethane as a refrigerant.

Advantages of the Invention

According to the present invention, the operation switching units (5) are provided separately from the gas-liquid separation unit (4). Thus, each of these units can be designed to have a smaller size, which will increase the flexibility of installation. In addition, compared to the configuration in which all of these units (4, 5) are integrated together, a more flexible reinstallation can be done depending on the number of the indoor units (3) to install.

According to the sixth aspect of the present invention, at the time of upgrading the air conditioner including the refrigerant circuit that comprises the outdoor unit (2) and the plurality of indoor units (3) to perform a cooling/heating switchable refrigeration cycle into the air conditioner including the refrigerant circuit (20) that can perform a refrigeration cycle in which a cooling operation and a heating operation are performed in parallel with each other, the operation switching unit connecting step, the gas-liquid separation unit connecting step, and the pipe connecting step are conducted. Consequently, an air conditioner making a switch from cooling to heating, and vice versa, can be easily upgraded into a cooling/heating free type air conditioner. In addition, preinstalled communication pipes may be used as the outdoor communication pipes (11, 12), the indoor communication pipes (13, 14), and the two intermediate communication pipes (15, 16). Only one communication pipe has to be newly added as the intermediate communication pipe (17). As a result, the reinstallation process can be conducted at a lower cost.

In the reinstallation method according to the sixth aspect of the present invention, the first step of the reinstallation method may be either the operation switching unit connecting step or the gas-liquid separation unit connecting step. Optionally, the pipe connecting step may be either the second step or the last step. According to the present invention, the reinstallation can be easily conducted irrespective of the order of conducting these steps. In addition, according to the present invention, the indoor communication pipes (13, 14) that form parts of preinstalled communication pipes, the outdoor communication pipes (11, 12) that form other parts of the preinstalled communication pipes, and the intermediate communication pipes (15, 16) that form still other parts of the preinstalled communication pipes may be used. Only one communication pipe to newly install is the intermediate communication pipe (17). As a result, the reinstallation process can be conducted at a lower cost.

According to the seventh aspect of the present invention, difluoromethane, which is a high-pressure working refrigerant, is used as a refrigerant. Thus, the tolerance range of the pressure loss of the refrigerant broadens. In general, when a cooling/heating free type air conditioner is newly installed on site by using two communication pipes, namely, the first and second communication pipes (11, 12), a difference in diameter between the two pipes is usually set to be smaller than the difference in diameter between the two communication pipes, namely, the first and second communication pipes (11, 12) of a cooling/heating switchable air conditioner yet to be upgraded. However, in the present invention, difluoromethane, which is a high-pressure working refrigerant, is used as a refrigerant, and thus even a cooling/heating free type air conditioner can be upgraded by using the preinstalled communication pipes of the air conditioner including a refrigerant circuit that can perform a cooling/heating switchable refrigeration cycle.

DESCRIPTION OF EMBODIMENTS

Embodiments of the present invention will now be described in detail below with reference to the drawings.

«First Embodiment of the Invention»

A first embodiment of the present invention will be described below.

This embodiment relates to a so-called "cooling/heating free type air conditioner" that includes a plurality of indoor units connected in parallel with a single outdoor unit to perform a cooling operation and a heating operation in parallel with each other. This air conditioner has a configuration which may be used suitably for upgrading a preinstalled indoor-multi-type air conditioner that performs either a cooling operation or a heating operation just selectively, not in parallel with each other, to a cooling/heating free type air conditioner. In the following description, the refrigerant circuit of the air conditioner yet to be upgraded is supposed to be filled with R410A or R22 as a previous refrigerant, and the refrigerant circuit of the upgraded air conditioner is supposed to be filled with R32 (difluoromethane) as a new refrigerant.

Figure 1:
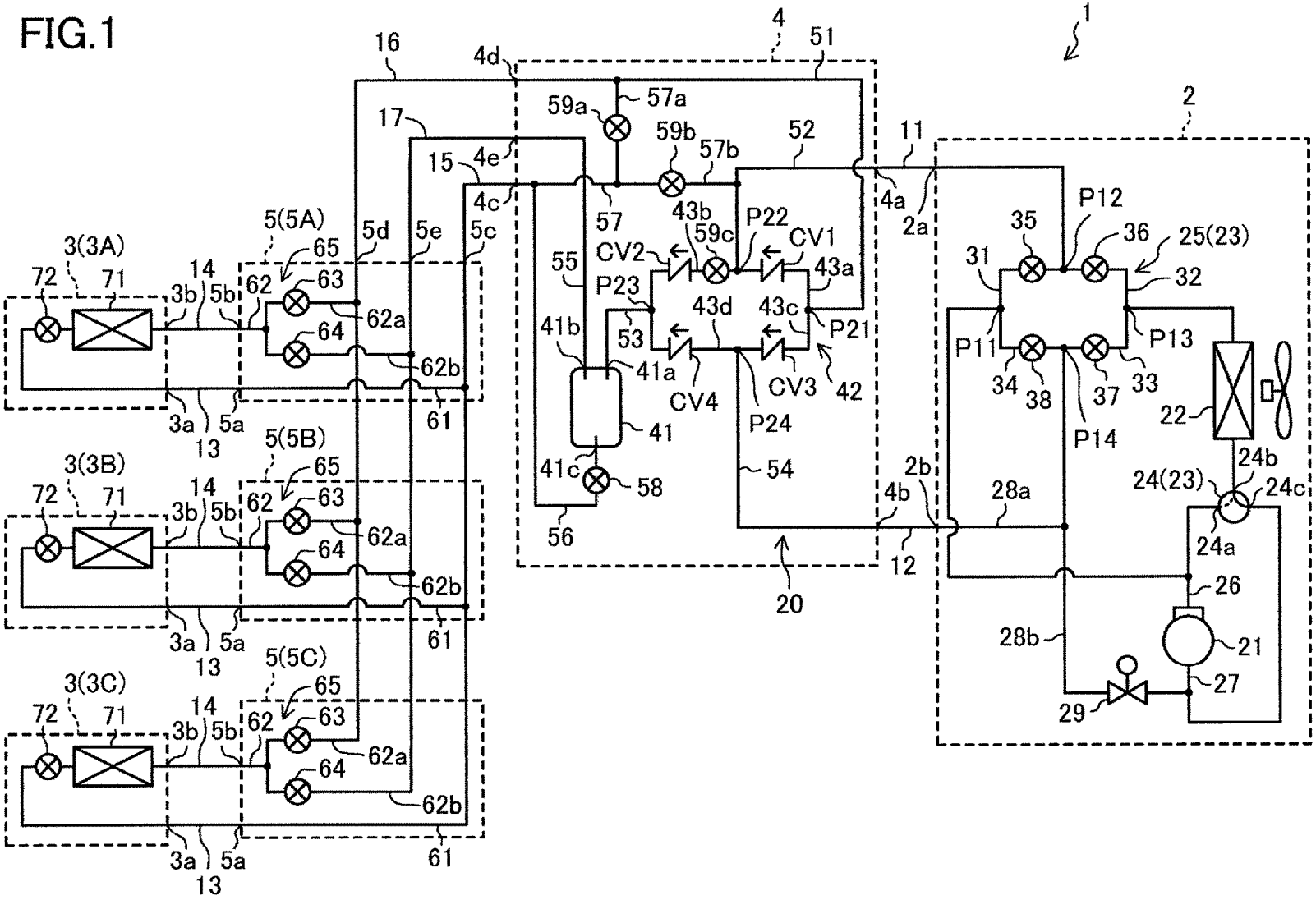
FIG. 1 illustrates a refrigerant circuit of an air conditioner according to a first embodiment of the present invention.

As illustrated in FIG. 1, this air conditioner (1) includes an outdoor unit (2), a plurality of (e.g., three in the example illustrated in FIG. 1) indoor units (3), a gas-liquid separation unit (4) including a gas-liquid separator, and as many operation switching units (5) as the indoor units (3). The gas-liquid separation unit (4) is provided separately from the operation switching units (5), and is connected to the outdoor unit (2) through two outdoor communication pipes (11, 12). Each of the operation switching units (5) is connected to an associated one of the indoor units (3) through two indoor communication pipes (13, 14). Also, each of the operation switching units (5) is connected in parallel to the gas-liquid separation unit (4) through three intermediate communication pipes (15, 16, 17). By connecting together the outdoor unit (2), the gas-liquid separation unit (4), the operation switching units (5), and the indoor units (3) in this manner, a refrigerant circuit (20) is formed which can perform a cooling/heating free type refrigeration cycle.

The outdoor communication pipes (11, 12) are comprised of a first outdoor communication pipe (11) and a second outdoor communication pipe (12). The indoor communication pipes (13, 14) are comprised of a first indoor communication pipe (13) and a second indoor communication pipe (14). The intermediate communication pipes (15, 16, 17) are comprised of a first intermediate communication pipe (15), a second intermediate communication pipe (16), and a third intermediate communication pipe (17). Regarding the outdoor communication pipes (11, 12), the indoor communication pipes (13, 14), and the intermediate communication pipes (15, 16, 17), their first communication pipes (11, 13, 15) have the same inside diameter. Their second communication pipes (12, 14, 16) have the same inside diameter, which is larger than the inside diameter of the first communication pipes. The third intermediate communication pipe (17) has the same inside diameter as the second intermediate communication pipe (16).

The outdoor unit (2) includes a compressor (21), an outdoor heat exchanger (a heat source-side heat exchanger) (22), and a switching mechanism (23). The compressor (21) compresses refrigerants. The outdoor heat exchanger (22) exchanges heat between the refrigerants and the outdoor air. The switching mechanism (23) changes the directions of the refrigerants flowing through the first and second outdoor communication pipes (11, 12). This outdoor unit (2) includes a first outdoor communication pipe port (2*a*) connected with the first outdoor communication pipe (11) and a second outdoor communication pipe port (2*b*) connected with the second outdoor communication pipe (12). The switching mechanism (23) includes a three-way valve (an operation mode switching section) (24) and a switching circuit (a pipe switching section) (25) comprised of four motor operated valves (35, 36, 37, 38) in combination.

The discharge-side pipe (26) of the compressor (21) is connected to a first port (24*a*) of the three-way valve (24). A second port (24*b*) of the three-way valve (24) is connected to a gas-side end of the outdoor heat exchanger (22). A third port (24*c*) of the three-way valve (24) is connected to the suction-side pipe (27) of the compressor (21). The liquid-side end of the outdoor heat exchanger (22) is connected to the switching circuit (25). The three-way valve (24) is a switching valve that switches communication states of the discharge-side pipe (26) and the suction-side pipe (27) to allow either the discharge-side pipe (26) or the suction-side pipe (27) of the compressor (21) to communicate with the gas-side end of the outdoor heat exchanger (22).

The switching circuit (25) includes four passages (31, 32, 33, 34), four connections (namely, a first connection point (P11), a second connection point (P12), a third connection point (P13), and a fourth connection point (P14)), and the four motor operated valves (opening/closing mechanisms) (35, 36, 37, 38). Each of the first, second, third and fourth connection points (P11, P12, P13, P14) connects their corresponding end portions of associated two of the four passages (31, 32, 33, 34). The four motor operated valves (35, 36, 37, 38) are provided for the passages (31, 32, 33, 34), respectively. In other words, the first, second, third and fourth outdoor motor operated valves (35, 36, 37, 38) are provided for the first, second, third and fourth passages (31, 32, 33, 34), respectively. More specifically, in the switching circuit (25), the first and second connection points (P11, P12) are connected together via the first passage (31), the second and third connection points (P12, P13) are connected together via the second passage (32), the third and fourth connection points (P13, P14) are connected together via the third passage (33), and the fourth and first connection points (P14, P11) are connected together via the fourth passage (34).

The first connection point (P11) of the switching circuit (25) is pipe-connected to the discharge-side pipe (26) of the compressor (21). The second connection point (P12) is pipe-connected to the first outdoor communication pipe (11). The third connection point (P13) is pipe-connected to the liquid-side end of the outdoor heat exchanger (22). The fourth connection point (P14) is connected to the second outdoor communication pipe (12) through a branch pipe (28*a*) and also connected to the suction-side pipe (27) of the compressor (21) through a branch pipe (28*b*). A solenoid valve (an on-off valve) (29) is provided for the branch pipe (28*b*) between the fourth connection point (P14) and the suction-side pipe (27) of the compressor (21).

The gas-liquid separation unit (4) includes a gas-liquid separator (41) and a refrigerant flow channel switching circuit (42) that switches flows of liquid refrigerants (or two-phase refrigerants) and gas refrigerants in the intermediate communication pipes (15, 16, 17) and the outdoor communication pipes (11, 12). The gas-liquid separation unit (4) also includes a first outdoor communication pipe port (4*a*) connected with the first outdoor communication pipe (11) and a second outdoor communication pipe port (4*b*) connected with the second outdoor communication pipe (12). The gas-liquid separation unit (4) includes a first intermediate communication pipe port (4*c*) connected with the first intermediate communication pipe (15), a second intermediate communication pipe port (4*d*) connected with the second intermediate communication pipe (16), and a third intermediate communication pipe port (4*e*) connected with the third intermediate communication pipe (17).

The refrigerant flow channel switching circuit (42) is a circuit including four passages (43*a*, 43*b*, 43*c*, 43*d*), four connections (namely, a first connection point (P21), a second connection point (P22), a third connection point (P23), and a fourth connection point (P24)), and four check valves (CV1, CV2, CV3, CV4). Each of the first, second, third and fourth connection points (P21, P22, P23, P24) connects their corresponding end portions of associated two of the four passages (43*a*, 43*b*, 43*c*, 43*d*). The four check valves (CV1, CV2, CV3, CV4) are provided for the passages (43*a*, 43*b*, 43*c*, 43*d*), respectively.

The first connection point (P21) of the refrigerant flow channel switching circuit (42) is connected to the second intermediate communication pipe port (4*d*) through a first connecting pipe (51). The second connection point (P22) of the refrigerant flow channel switching circuit (42) is connected to the first outdoor communication pipe port (4*a*) through a second connecting pipe (52). The third connection point (P23) of the refrigerant flow channel switching circuit (42) is connected to a refrigerant inlet (41*a*) of the gas-liquid separator (41) through a third connecting pipe (53). The fourth connection point (P24) of the refrigerant flow channel switching circuit (42) is connected to the second outdoor communication pipe port (4*b*) through a fourth connecting pipe (54).

The gas-liquid separator (41) has its gas refrigerant outlet (41*b*) connected to the third intermediate communication pipe port (4*e*) through a fifth connecting pipe (55). The gas-liquid separator (41) also has its liquid refrigerant outlet (41*c*) connected to the first intermediate communication pipe port (4*c*) through a sixth connecting pipe (56) having a first intermediate motor operated valve (58). The sixth connecting pipe (56) is connected with a seventh connecting pipe (57) at a point between the first intermediate motor operated valve (58) and the first intermediate communication pipe port (4*c*). The seventh connecting pipe (57) is branch piping comprised of a first branch pipe (57*a*) and a second branch pipe (57*b*). The first branch pipe (57*a*) is connected to the first connecting pipe (51). The second branch pipe (57*b*) is connected to the second connecting pipe (52). A second intermediate motor operated valve (59*a*) and a third intermediate motor operated valve (59*b*) are provided for the first branch pipe (57*a*) and the second branch pipe (57*b*), respectively.

The refrigerant flow channel switching circuit (42) includes first, second, third and fourth check valves (CV1, CV2, CV3, CV4) as the four check valves. The first check valve (CV1) allows the refrigerant to flow from the first connection point (P21) toward the second connection point (P22), but prohibits the refrigerant from flowing in reverse direction. The second check valve (CV2) allows the refrigerant to flow from the second connection point (P22) toward the third connection point (P23), but prohibits the refrigerant from flowing in reverse direction. The third check valve (CV3) allows the refrigerant to flow from the first connection point (P21) toward the fourth connection point (P24), but prohibits the refrigerant from flowing in reverse direction. The fourth check valve (CV4) allows the refrigerant to flow from the fourth connection point (P24) toward the third connection point (P23), but prohibits the refrigerant from flowing in reverse direction.

A fourth intermediate motor operated valve (59*c*) is also provided for the passage (43*b*) of the refrigerant flow channel switching circuit (42) at a point between the second connection point (P22) and the second check valve (CV2). The fourth intermediate motor operated valve (59*c*) is closed during the full-cooling operation to be described later (see FIG. 10) to prevent the refrigerant from flowing into the gas-liquid separator (41).

Each of the operation switching units (5) is connected to its associated indoor unit (3) through the two indoor communication pipes (13, 14). The operation switching units (5) each include a flow channel switching circuit (65) that switches the flow channels of a liquid refrigerant and a gas refrigerant between the intermediate communication pipes (15, 16, 17) and the indoor communication pipes (13, 14) in response to a switch made by the indoor unit (3) from a cooling operation into a heating operation, and vice versa. The operation switching units (5) also each include a first indoor communication pipe port (5*a*) connected with the first indoor communication pipe (13), a second indoor communication pipe port (5*b*) connected with the second indoor communication pipe (14), a first intermediate communication pipe port (5*c*) connected with the first intermediate communication pipe (15), a second intermediate communication pipe port (5*d*) connected with the second intermediate communication pipe (16), and a third intermediate communication pipe port (5*e*) connected with the third intermediate communication pipe (17).

The operation switching units (5) each include a first communicating tube (61) and a second communicating tube (62). The first communicating tube (61) connects the first indoor communication pipe port (5*a*) with the first intermediate communication pipe port (5*c*). The second communicating tube (62) connects the second indoor communication pipe port (5*b*) with the second and third intermediate communication pipe ports (5*d*, 5*e*) in parallel with each other.

The second communicating tube (62) is branch piping comprised of a first branch pipe (62*a*) connected to the second intermediate communication pipe port (5*d*) and a second branch pipe (62*b*) connected to the third intermediate communication pipe port (5*e*). A first switching valve (63) and a second switching valve (64) are also provided for the first and second branch pipes (62*a*, 62*b*), respectively. The first and second switching valves (63, 64) form the flow channel switching circuit (65).

The indoor units (3) each include an indoor heat exchanger (71) and an indoor expansion valve (72). The indoor units (3) each include a first indoor communication pipe port (3*a*) and a second indoor communication pipe port (3*b*). The indoor expansion valve (72) and the indoor heat exchanger (71) are connected in this order between the first and second indoor communication pipe ports (3*a*, 3*b*).

The first intermediate communication pipe port (5*c*) of the operation switching unit (5) is connected with the first intermediate communication pipe port (4*c*) of the gas-liquid separation unit (4) through the first intermediate communication pipe (15). The second intermediate communication pipe port (5*d*) of the operation switching unit (5) is connected with the second intermediate communication pipe port (4*d*) of the gas-liquid separation unit (4) through the second intermediate communication pipe (16). The third intermediate communication pipe port (5*e*) of the operation switching unit (5) is connected with the third intermediate communication pipe port (4*e*) of the gas-liquid separation unit (4) through the third intermediate communication pipe (17). The first intermediate communication pipe (15) forms part of a liquid-side communication pipe. The second and third intermediate communication pipes (16, 17) form parts of a gas-side communication pipe.

The first indoor communication pipe port (5*a*) of the operation switching unit (5) is connected with the first indoor communication pipe port (3*a*) of the indoor unit (3) through the first indoor communication pipe (13). The second indoor communication pipe port (5*b*) of the operation switching unit (5) is connected with the second indoor communication pipe port (3*b*) of the indoor unit (3) through the second indoor communication pipe (14). The first indoor communication pipe (13) forms part of the liquid-side communication pipe. The second indoor communication pipe (14) forms part of the gas-side communication pipe.

Next, the setting of will be described with reference to FIGS. 2A and 2B. In this embodiment, the switching mechanism (23) is configured to change the flow directions of a refrigerant according to the given load during a heating dominant operation where the heating load is heavier than the cooling load (see FIG. 2A). Specifically, the switching mechanism (23) is configured to change the directions of refrigerant flowing through the first and second outdoor communication pipes (11, 12) depending on whether the heating dominant operation to be performed between a full-heating load operation and a balanced heating and cooling load operation is performed in a first load region ranging from a full-heating load to a partial-cooling load (i.e., a region where the first heating dominant operation is conducted) or a second load region ranging from the partial-cooling load to balanced heating and cooling loads (i.e., a region where the second heating dominant operation is conducted).

Figure 2A:
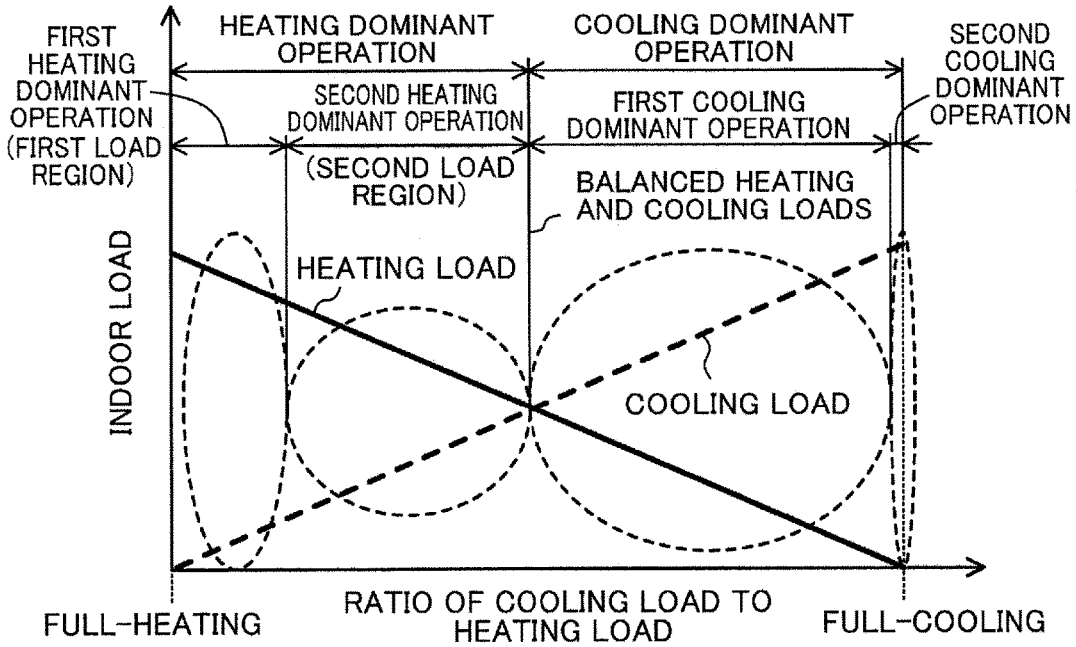
FIG. 2A is a graph showing four operation modes of the air conditioner by the ratio of a cooling load to a heating load.
Figure 2B:
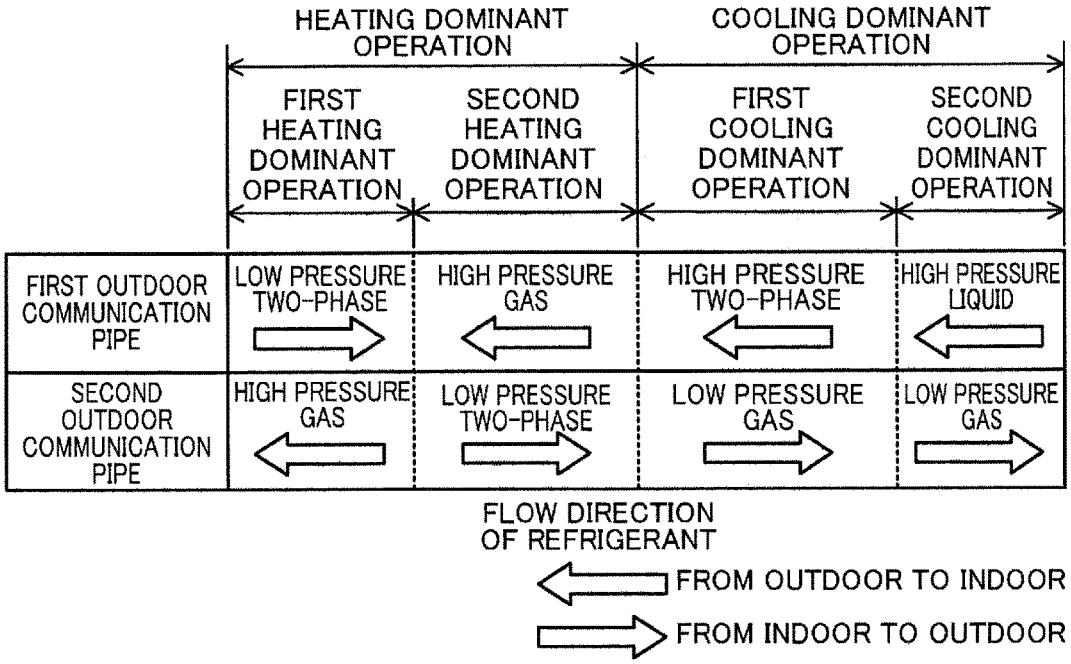
FIG. 2B is a table showing the flow directions of refrigerants on an operation mode basis.

As illustrated in FIG. 2B, in the first load region (i.e., the first heating dominant operation region), the switching mechanism (23) is configured to allow a high-pressure gas refrigerant to flow from the outdoor unit (2) to the indoor unit (3) through the second outdoor communication pipe (12), and also allow a low-pressure two-phase refrigerant to flow from the indoor unit (3) to the outdoor unit (2) through the first outdoor communication pipe (11). In the second load region (i.e., the second heating dominant operation region), the switching mechanism (23) is configured to allow a high-pressure gas refrigerant to flow from the outdoor unit (2) to the indoor unit (3) through the first outdoor communication pipe (11), and also allow a low-pressure two-phase refrigerant to flow from the indoor unit (3) to the outdoor unit (2) through the second outdoor communication pipe (12).

In all of those regions of the heating dominant operation including the first and second load regions, the switching mechanism (23) is also configured to perform a refrigeration cycle in the refrigerant circuit (20) such that the outdoor heat exchanger (22) in the outdoor unit (2) serves as an evaporator.

The switching mechanism (23) includes the pipe switching section (25) and the operation mode switching section (24). As described above, the pipe switching section (25) is also implemented as the switching circuit (25), and the operation mode switching section (24) is implemented as the three-way valve (24).

Figure 8:
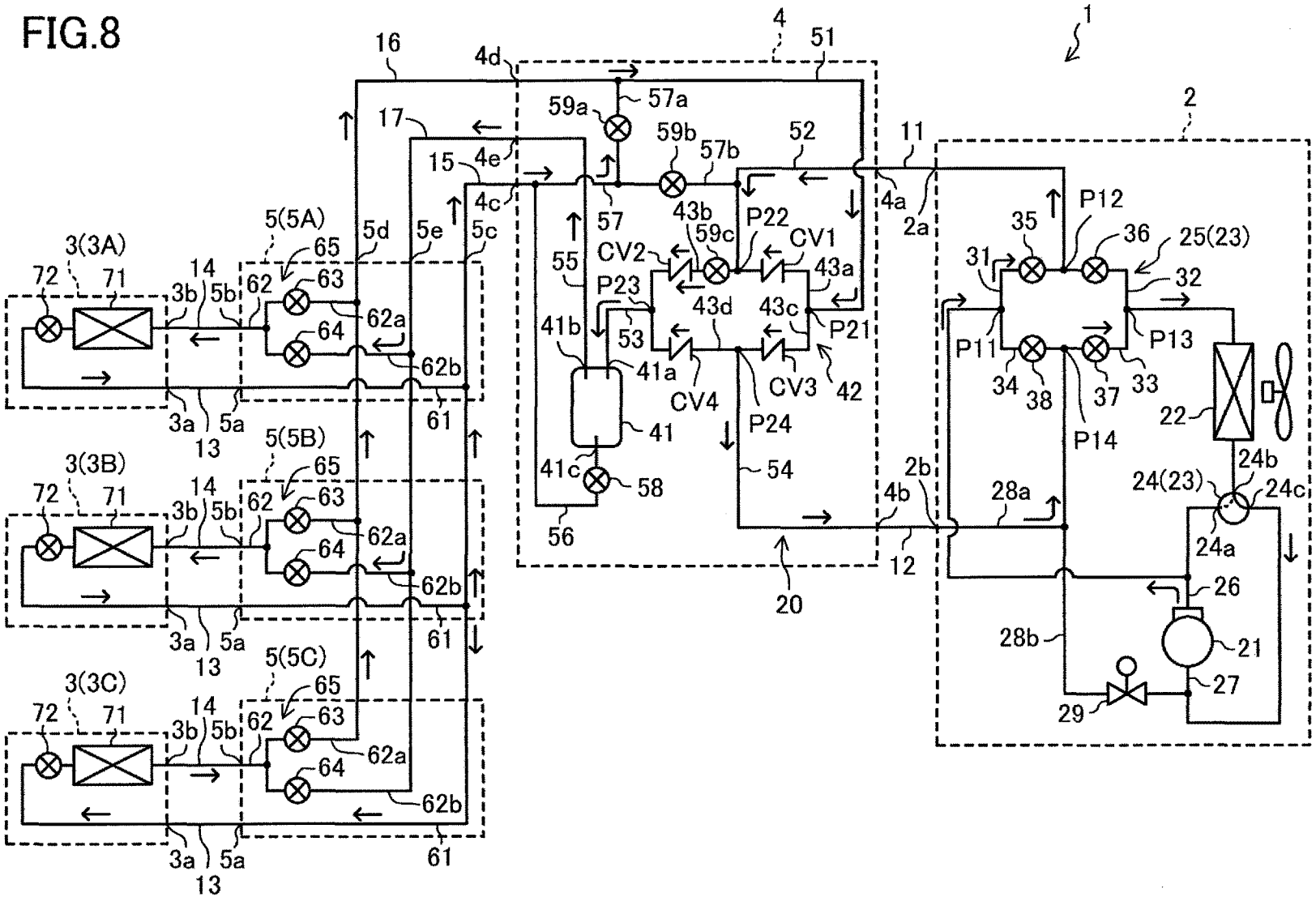
FIG. 8 illustrates the directions in which refrigerants flow through the refrigerant circuit of FIG. 1 during a second heating dominant operation.

The switching circuit (25) is configured to be able to make a switch from a first position (see FIG. 6) to a second position (see FIG. 8), and vice versa. The switching circuit (25) in the first position allows a high-pressure refrigerant discharged from the compressor (21) in the first load region to enter the second outdoor communication pipe (12), and allows a low-pressure refrigerant returning from the indoor units (3) to the outdoor unit (2) through the first outdoor communication pipe (11) to enter the outdoor heat exchanger (22). The switching circuit (25) in the second position allows a high-pressure refrigerant discharged from the compressor (21) in the second load region to enter the first outdoor communication pipe (11), and allows a low-pressure refrigerant returning from the indoor units (3) to the outdoor unit (2) through the second outdoor communication pipe (12) to enter the outdoor heat exchanger (22).

When the switching circuit (25) is in the first position, the second and fourth outdoor motor operated valves (36, 38) are opened, and the first and third outdoor motor operated valves (35, 37) are closed. When the switching circuit (25) is in the second position, the first and third outdoor motor operated valves (35, 37) are opened, and the second and fourth outdoor motor operated valves (36, 38) are closed. During the cooling dominant operation, on the other hand, the opened/closed states of the respective motor operated valves (35, 36, 37, 38) are different from their states in the first or second position during the heating dominant operation. The opened/closed states of the respective motor operated valves (35, 36, 37, 38) in such a situation will be described later.

The three-way valve (24) is configured to be able to make a switch from a first position (see FIGS. 6 and 7) at which the heating dominant operation is conducted to a second position (see FIGS. 9 and 10) at which the cooling dominant operation is conducted, and vice versa. The three-way valve (24) in the first position allows a high-pressure refrigerant discharged from the compressor (21) to enter the first or second outdoor communication pipes (11, 12) through the switching circuit (25), and also allows a low-pressure refrigerant evaporated in the outdoor heat exchanger (22) to enter the compressor (21). The three-way valve (24) in the second position allows a high-pressure refrigerant discharged from the compressor (21) to enter the first outdoor communication pipe (11) through the outdoor heat exchanger (22) and the switching circuit (25), and also allows a refrigerant returning to the outdoor unit (2) through the second outdoor communication pipe (12) to enter the compressor (21). When the three-way valve (24) is in the first position, the first port (24*a*) is closed but the second and third ports (24*b*, 24*c*) communicate with each other. When the three-way valve (24) is in the second position, the first and second ports (24*a*, 24*b*) communicate with each other but the third port (24*c*) is closed.

—Method for Reinstalling the Air Conditioner (1)—

Next, a method for reinstalling this air conditioner (1) will be described.

The method for reinstalling the air conditioner (1) according to this embodiment is a reinstallation method for upgrading an air conditioner (1A) including a refrigerant circuit that comprises an outdoor unit (2) and a plurality of indoor units (3) to perform a cooling/heating switchable refrigeration cycle into an air conditioner (1B) including a refrigerant circuit that can perform a refrigeration cycle in which a cooling operation and a heating operation are performed in parallel with each other.

Figure 3:
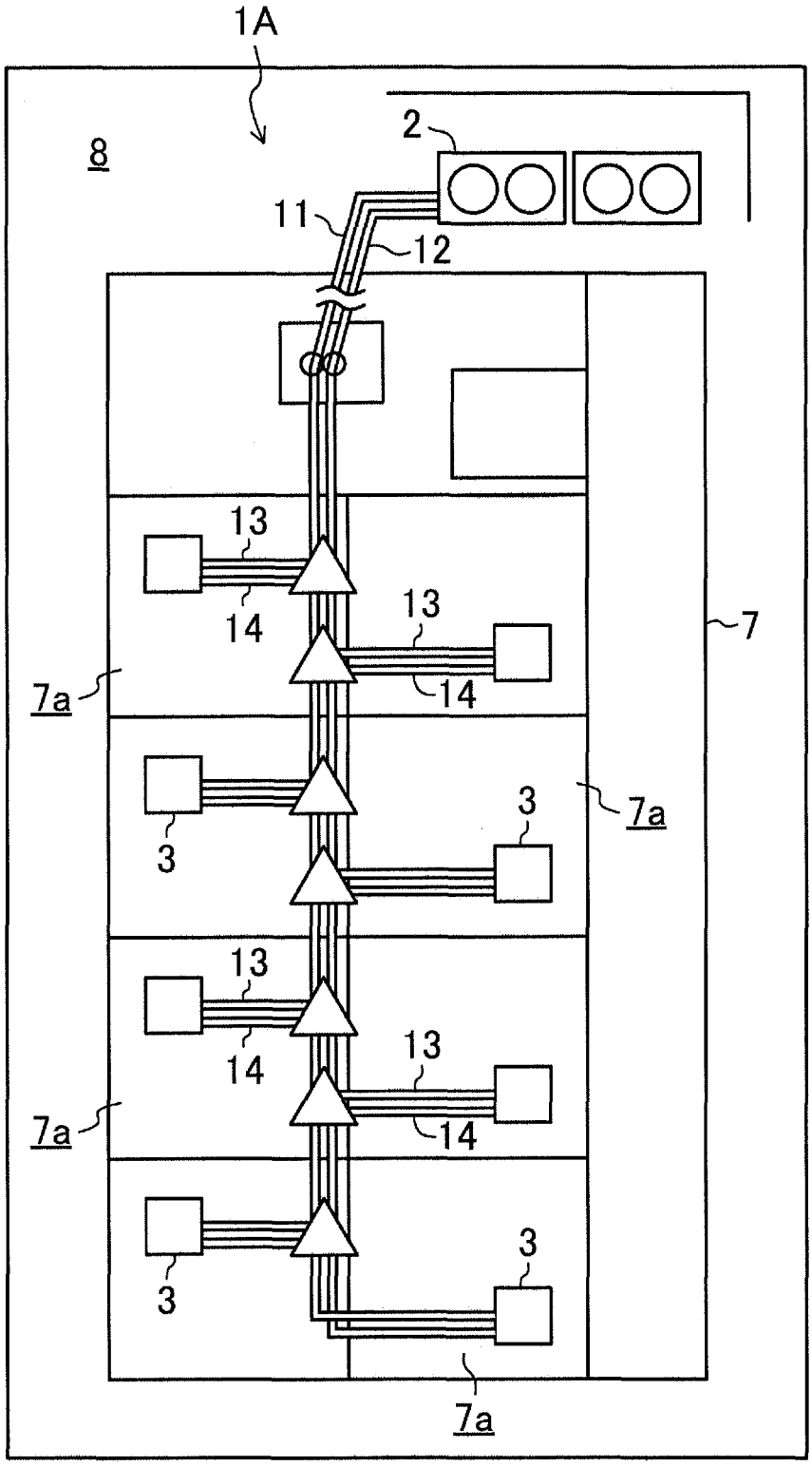
FIG. 3 illustrates a general configuration for an indoor-multi-type air conditioner in which multiple indoor units are connected in parallel with a single outdoor unit to make a switch from cooling to heating, and vice versa.
Figure 4:
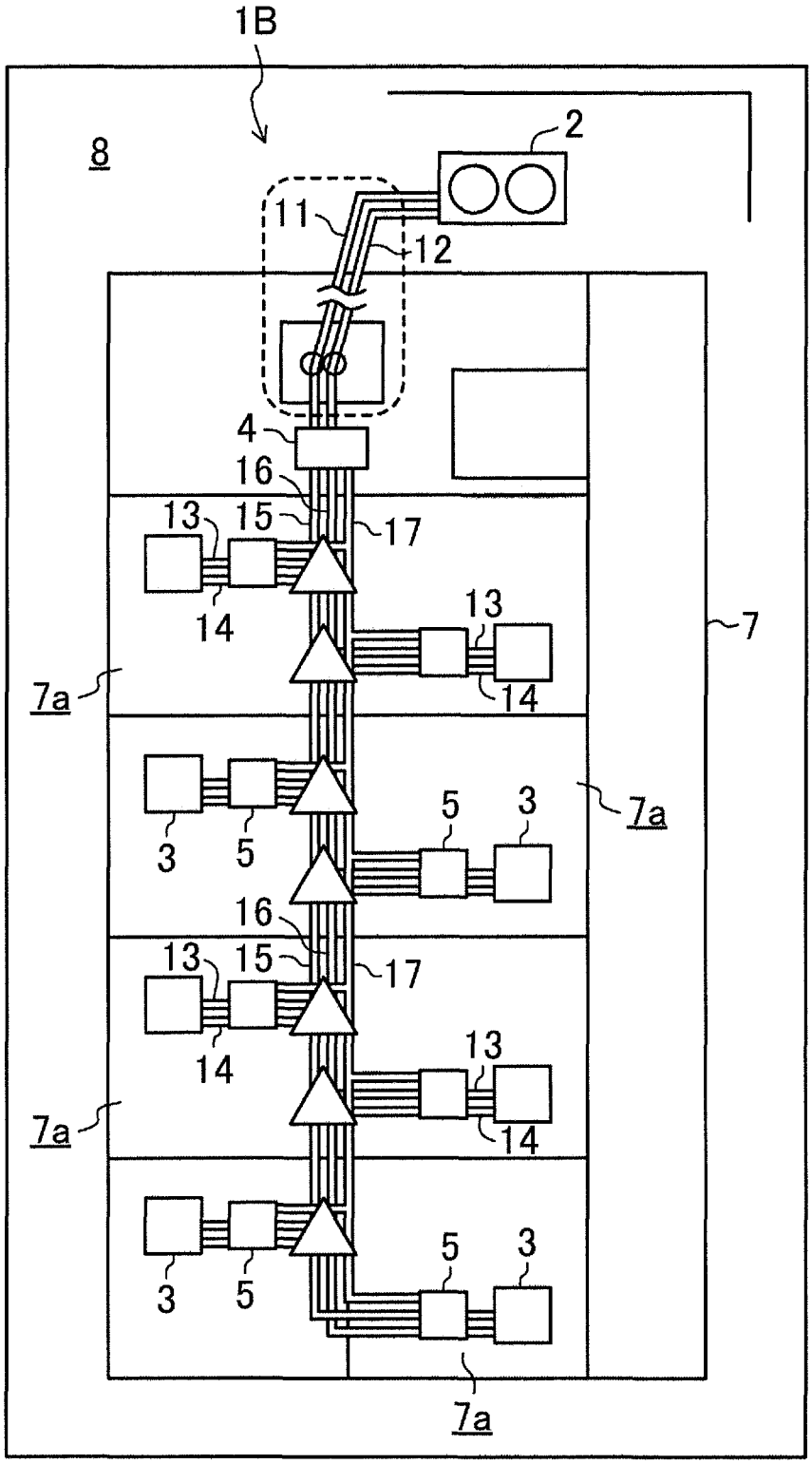
FIG. 4 illustrates a general configuration for an air conditioner according to an embodiment that can perform a cooling operation and a heating operation in parallel with each other.
Figure 5:
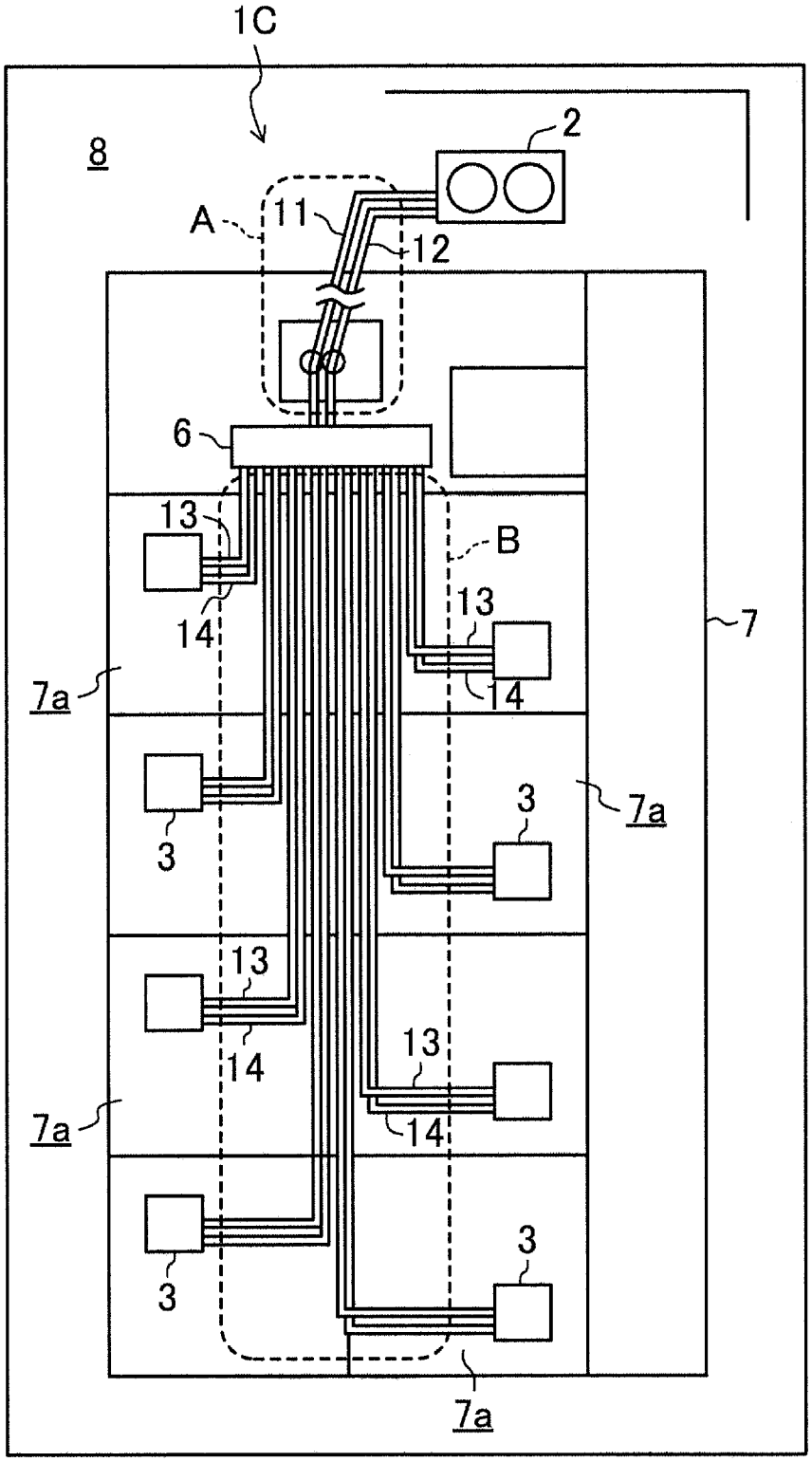
FIG. 5 illustrates a general configuration for a typical conventional cooling/heating free type air conditioner (as a comparative example).

FIG. 3 illustrates the preinstalled indoor-multi-type air conditioner (1A) (yet to be upgraded) including an outdoor unit (2) and a plurality of indoor units (3). The indoor units (3) are connected in parallel with the outdoor unit (2) through the first communication pipe (11, 13) and the second communication pipe (12, 14) so that the air conditioner (1A) is switchable from a cooling operation into a heating operation, and vice versa. On the other hand, FIG. 4 illustrates an air conditioner (1B) according to this embodiment which has been upgraded into a cooling/heating free type that can perform a cooling operation and a heating operation in parallel with each other. In these drawings, the reference numeral (7) denotes a structure such as a building. The reference numeral (7*a*) denotes the indoor space to be air-conditioned. The reference numeral (8) denotes an outdoor machine room. FIG. 5 illustrates, as a comparative example, an air conditioner (1C) including a cooling/heating switching unit (6) formed by integrating the gas-liquid separation unit (4) with the operation switching units (5). The air conditioner (1C) of the comparative example is an air conditioner to be newly installed in its entirety.

The reinstallation method of this embodiment includes an operation switching unit connecting step to connect each operation switching unit (5) with its associated indoor unit (3) on an indoor unit basis, a gas-liquid separation unit connecting step to connect the gas-liquid separation unit (4) with the outdoor unit (2), and a pipe connecting step to connect the operation switching units (5) with the gas-liquid separation unit (4) in parallel with each other.

The operation switching unit connecting step is a step to connect each of the operation switching units (5), which changes the directions of a refrigerant flowing through its associated indoor unit (3) in response to a switch from a cooling operation to a heating operation, or vice versa, with the associated indoor unit (3) through two indoor communication pipes (13, 14) that form parts of the preinstalled communication piping.

The gas-liquid separation unit connecting step is a step to connect the gas-liquid separation unit (4), which is disposed separately from the operation switching units (5) in order to change the flow directions of a liquid refrigerant and a gas refrigerant, with the outdoor unit (2) through two outdoor communication pipes (11, 12) that form other parts of the preinstalled communication piping.

The pipe connecting step is a step to connect the operation switching units (5) with the gas-liquid separation unit (4) in parallel with each other through two intermediate communication pipes (15, 16) that form still other parts of the preinstalled communication piping, and one intermediate communication pipe (17) newly installed.

The first step of the reinstallation method of this embodiment may be either the operation switching unit connecting step or the gas-liquid separation unit connecting step. Optionally, the pipe connecting step may be either the second step or the last step.

—Operation—

Next, it will be described how the air conditioner (1) of this embodiment operates.

In this embodiment, a first heating dominant operation is conducted when the heating dominant operation is performed in the first load region shown in FIGS. 2A and 2B.

A second heating dominant operation is conducted when the heating dominant operation is performed in the second load region. A first cooling dominant operation is conducted when the cooling dominant operation is performed in a region where the heating load is also processed. A second cooling dominant operation is conducted in the region where a full-cooling operation is performed.

In the following description, the three indoor units (3) shown in FIGS. 1 and 6-9 will be hereinafter referred to as, if necessary, a first indoor unit (3A), a second indoor unit (3B), and a third indoor unit (3C), respectively, from top to bottom. Likewise, the operation switching units (5) will also be hereinafter referred to as, if necessary, a first operation switching unit (5A), a second operation switching unit (5B), and a third operation switching unit (5C), respectively, from top to bottom.

<First Heating Dominant Operation>

The first heating dominant operation is an operation conducted in the first load region where the cooling load, out of the entire air conditioning load, is as low as from zero to approximately 20%. A full-heating operation will be described as an example of the first heating dominant operation with reference to FIG. 6.

In this case, in the outdoor unit (2), the three-way valve (24) is set to be the first position, the switching circuit (25) set to be the first position, and the solenoid valve (29) is closed. In the gas-liquid separation unit (4), the third intermediate motor operated valve (59*b*) is opened, and the first, second and fourth intermediate motor operated valves (58, 59*a*, 59*c*) are closed. In each of the operation switching units (5), the second switching valve (64) is opened and the first switching valve (63) is closed. In each of the indoor units (3), the indoor expansion valve (72) is opened.

When the compressor (21) is started, a high-pressure gas refrigerant discharged passes through the switching circuit (25) and then flows into the gas-liquid separation unit (4) through the second outdoor communication pipe (12). The high-pressure gas refrigerant passes through the gas-liquid separator (41) and flows into the respective operation switching units (5) through the third intermediate communication pipe (17). The high-pressure gas refrigerant further passes through the second indoor communication pipe (14) and flows into the respective indoor units (3). After having condensed in the indoor heat exchanger (71) to heat the indoor air, the refrigerant flows out of the indoor units (3), and passes through the first indoor communication pipe (13), the operation switching units (5), and the first intermediate communication pipe (15) to flow into the gas-liquid separation unit (4). The liquid refrigerant passes through the third intermediate motor operated valve (59*b*), the second connecting pipe (52), and the first outdoor communication pipe (11) to return to the outdoor unit (2). The liquid refrigerant flowed into the outdoor unit (2) is expanded in the second outdoor motor operated valve (36) of the switching circuit (25). Then, the liquid refrigerant evaporates in the outdoor heat exchanger (22) and is sucked into the compressor (21).

Such circulation of the refrigerants through the refrigerant circuit (20) allows all of the indoor units (3) to perform a heating operation.

In the example described above, the third intermediate motor operated valve (59*b*) is opened, and the refrigerant is expanded in the second outdoor motor operated valve (36) of the switching circuit (25). Alternatively, the refrigerant may be expanded in the third intermediate motor operated valve (59*b*), and the second outdoor motor operated valve (36) may be opened. Still alternatively, the refrigerant may also be expanded using both of these motor operated valves (59*b*, 36).

Figure 6:
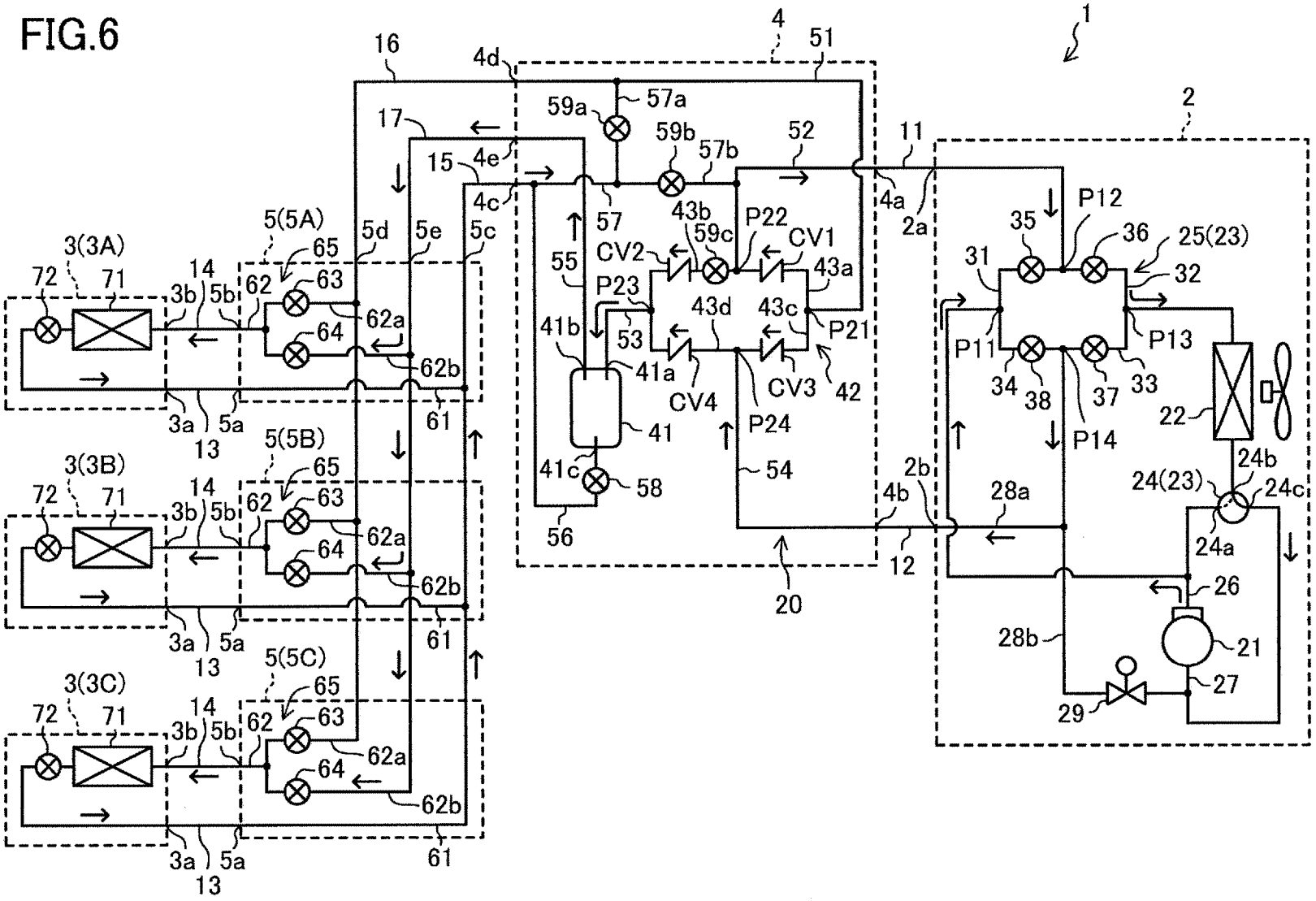
FIG. 6 illustrates the directions in which refrigerants flow through the refrigerant circuit of FIG. 1 during a first heating dominant operation.
Figure 7:
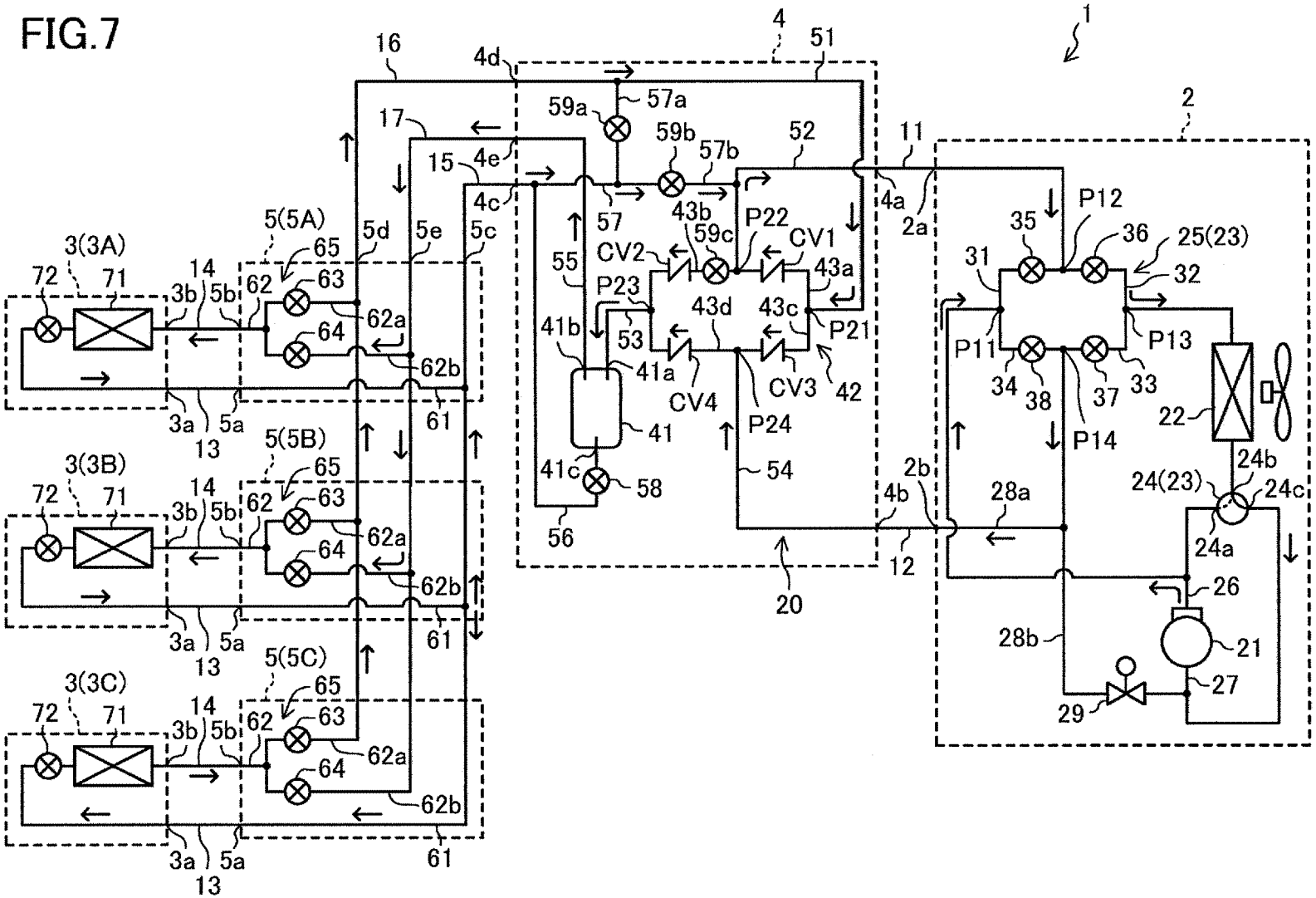
FIG. 7 illustrates the directions in which refrigerants flow through the refrigerant circuit of FIG. 1 during the first heating dominant operation where a cooling load is generated.

Although a full-heating operation has been described as an exemplary first heating dominant operation with reference to FIG. 6, the first heating dominant operation may also include a cooling operation performed by some of the plurality of indoor units (3) as illustrated in FIG. 7.

In this case, in the outdoor unit (2), the three-way valve (24) is set to be the first position, the switching circuit (25) is set to be the first position, and the solenoid valve (29) is closed. The second outdoor motor operated valve (36) is opened. In the gas-liquid separation unit (4), the third intermediate motor operated valve (59*b*) is adjusted to a predetermined degree of opening, and the first, second and fourth intermediate motor operated valves (58, 59*a*, 59*c*) are closed. In the first and second operation switching units (5A, 5B) performing a heating operation, the second switching valve (64) is opened and the first switching valve (63) is closed. In the third operation switching unit (5C) performing a cooling operation, the first switching valve (63) is opened and the second switching valve (64) is closed.

When the compressor (21) is started, a high-pressure gas refrigerant discharged passes through the switching circuit (25) and flows into the gas-liquid separation unit (4) through the second outdoor communication pipe (12). The high-pressure gas refrigerant passes through the gas-liquid separator (41) and flows into the first and second operation switching units (5A, 5B) through the third intermediate communication pipe (17). The high-pressure gas refrigerant further passes through the second indoor communication pipe (14) and flows into the first and second indoor units (3A, 3B). After having condensed in the indoor heat exchangers (71) to heat the indoor air, the refrigerants flow out of the first and second indoor units (3A, 3B) and pass through the first indoor communication pipes (13) and the first and second operation switching units (5A, 5B). Then, the refrigerants branch via the first intermediate communication pipe (15) into a refrigerant flowing into the gas-liquid separation unit (4) and a refrigerant flowing into the third operation switching unit (5C).

The refrigerant flows out of the third operation switching unit (5C) into the third indoor unit (3C) through the first indoor communication pipe (13), and evaporates in the indoor heat exchanger (71). Then, the refrigerant passes through the second indoor communication pipe (14) and the second intermediate communication pipe (16) to return to the gas-liquid separation unit (4).

The liquid refrigerant flowed out of the first intermediate communication pipe (15) into the gas-liquid separation unit (4) has its pressure reduced by the third intermediate motor operated valve (59*b*) to become a low-pressure two-phase refrigerant, which then flows into the second connecting pipe (52). The gas refrigerant flowed out of the second intermediate communication pipe (16) into the gas-liquid separation unit (4) passes through the first connecting pipe (51), the first connection point (P21), the passage (43*a*), and the second connection point (P22), and joins the low-pressure two-phase refrigerant in the second connecting pipe (52). The confluent refrigerant serves as a low-pressure two-phase refrigerant.

This low-pressure two-phase refrigerant passes through the first outdoor communication pipe (11) to return to the outdoor unit (2). After passing through the second outdoor motor operated valve (36) of the switching circuit (25), the low-pressure two-phase refrigerant evaporates in the outdoor heat exchanger (22) and is sucked into the compressor (21).

Such circulation of the refrigerants through the refrigerant circuit (20) allows most of the indoor units (3) to perform a heating operation and allows only some of them to perform a cooling operation.

<Second Heating Dominant Operation>

In this case, in the outdoor unit (2), the three-way valve (24) is set to be the first position, the switching circuit (25) is set to be the second position, and the solenoid valve (29) is closed. In the gas-liquid separation unit (4), the second and fourth intermediate motor operated valves (59*a*, 59*c*) are opened, and the first and third intermediate motor operated valves (58, 59*b*) are closed. In the first and second operation switching units (5A, 5B), the first switching valve (63) is closed and the second switching valve (64) is opened. In the third operation switching unit (5C), the first switching valve (63) is opened and the second switching valve (64) is closed. In the first and second indoor units (3A, 3B), the indoor expansion valve (72) is opened. In the third indoor unit (3C), the indoor expansion valve (72) has its degree of opening adjusted.

In this state, the compressor (21) discharges a high-pressure gas refrigerant, which passes through the switching circuit (25) and flows into the gas-liquid separation unit (4) through the first outdoor communication pipe (11). The high-pressure gas refrigerant passes through the refrigerant flow channel switching circuit (42) and flows into the gas-liquid separator (41). The high-pressure gas refrigerant flows out of the gas refrigerant outlet (41*b*) of the gas-liquid separator (41) and passes through the third intermediate communication pipe (17) to flow into the respective operation switching units (5).

As described above, in the first and second operation switching units (5A, 5B), the second switching valve (64) is opened and the first switching valve (63) is closed. In the third operation switching unit (5C), the first switching valve (63) is opened and the second switching valve (64) is closed. This allows the refrigerants to flow from the first and second operation switching units (5A, 5B) into the first and second indoor units (3A, 3B) through the second indoor communication pipes (14). In the first and second indoor units (3A, 3B), the refrigerants condense and dissipate heat to heat the indoor air. The liquid refrigerants condensed return to the first and second operation switching units (5A, 5B). Some part of the liquid refrigerants condensed goes toward the third operation switching unit (5C), and another part of the liquid refrigerants condensed goes toward the gas-liquid separation unit (4).

The liquid refrigerant flowed into the third operation switching unit (5C) further passes through the first indoor communication pipe (13) to flow into the third indoor unit (3C) where the liquid refrigerant has its pressure reduced by the indoor expansion valve (72) to become a low-pressure two-phase refrigerant. This low-pressure two-phase refrigerant evaporates in the indoor heat exchanger (71) to become a gas refrigerant, and flows out of the third indoor unit (3C) into the third operation switching unit (5C) through the second indoor communication pipe (14). The gas refrigerant flowed into the third operation switching unit (5C) flows out of the first branch pipe (62*a*) into the gas-liquid separation unit (4) through the second intermediate communication pipe (16).

In the gas-liquid separation unit (4), the liquid refrigerant flowed in from the first and second operation switching units (5A, 5B) has its pressure reduced by the second intermediate motor operated valve (59*a*) to become a low-pressure two-phase refrigerant and confluent with a low-pressure gas refrigerant flowed in from the third operation switching unit (5C). The mixture of the low-pressure two-phase refrigerant and the low-pressure gas refrigerant is a low-pressure two-phase refrigerant, which returns from the refrigerant flow channel switching circuit (42) to the outdoor unit (2) through the second outdoor communication pipe (12). The low-pressure two-phase refrigerant returned to the outdoor unit (2) passes through the switching circuit (25) to flow into the outdoor heat exchanger (22) where the low-pressure two-phase refrigerant exchanges heat with the outdoor air and evaporates. The low-pressure gas refrigerant evaporated in the outdoor heat exchanger (22) passes through the three-way valve (24), and is sucked into the compressor (21).

Such circulation of the refrigerants through the refrigerant circuit (20) contributes to a refrigeration cycle in which the first and second indoor units (3A, 3B) perform a heating operation and the third indoor unit (3C) performs a cooling operation.

<First Cooling Dominant Operation>

Figure 9:
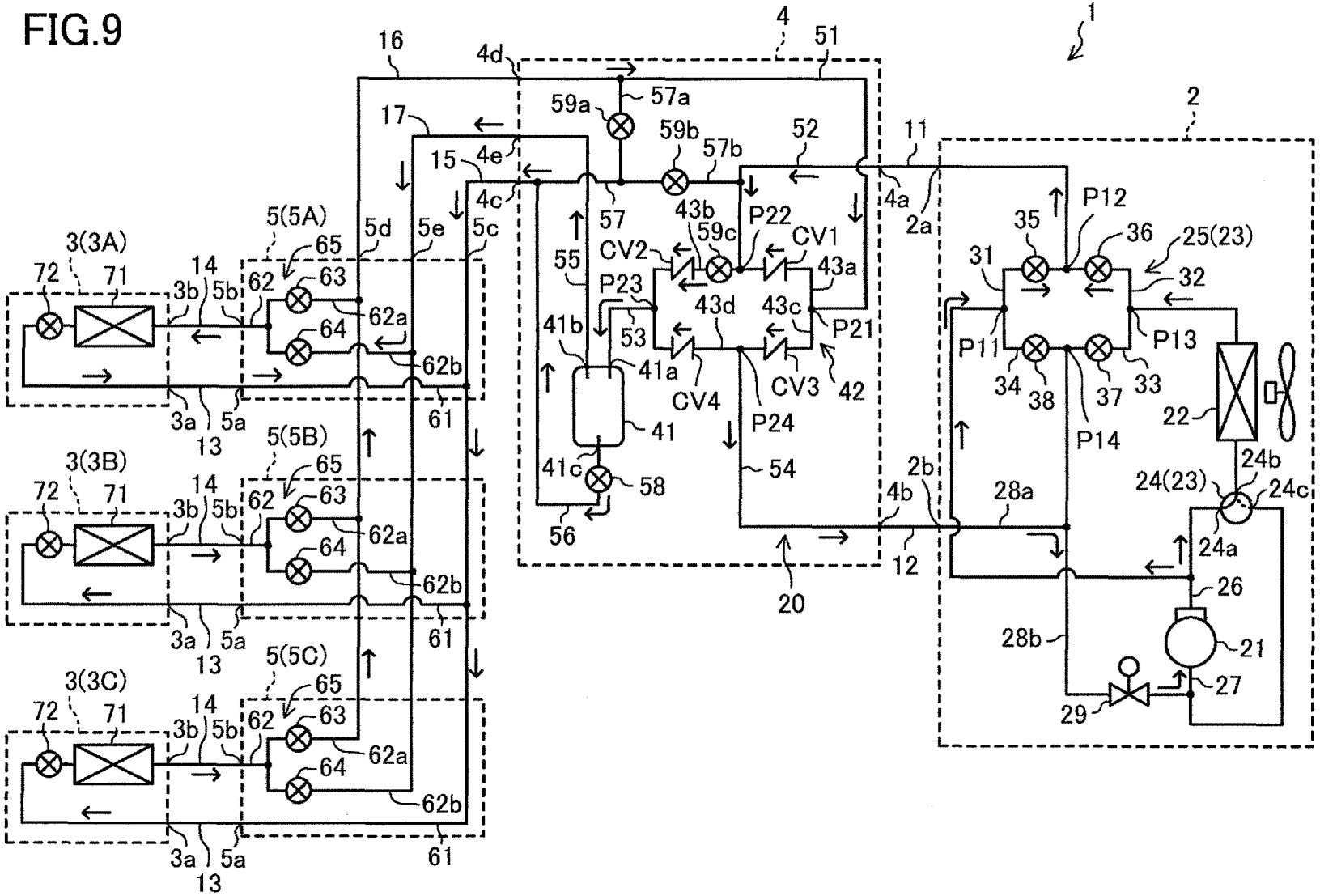
FIG. 9 illustrates the directions in which refrigerants flow through the refrigerant circuit of FIG. 1 during a first cooling dominant operation.

Next, a mode in which the first indoor unit (3A) performs a heating operation and the second and third indoor units (3B, 3C) perform a cooling operation will be described as a first cooling dominant operation with reference to FIG. 9.

In this case, in the outdoor unit (2), the three-way valve (24) is set to be the second position, and the first and second outdoor motor operated valves (35, 36) of the switching circuit (25) are opened, and the third and fourth outdoor motor operated valves (37, 38) thereof are closed. The solenoid valve (29) is opened. In the gas-liquid separation unit (4), the first and fourth intermediate motor operated valves (58) are opened, and the second and third intermediate motor operated valves (59*a*, 59*b*) are closed. In the first operation switching unit (5A), the first switching valve (63) is closed and the second switching valve (64) is opened. In the second and third operation switching units (5B, 5C), the first switching valve (63) is opened and the second switching valve (64) is closed. In the first indoor unit (3A), the indoor expansion valve (72) is opened. In the second and third indoor units (3B, 3C), the indoor expansion valve (72) has its degree of opening adjusted.

In this state, the compressor (21) discharges a high-pressure gas refrigerant, part of which passes through the three-way valve (24) to flow into the outdoor heat exchanger (22) where the high-pressure gas refrigerant condenses to become a liquid refrigerant to flow into the switching circuit (25). Another part of the high-pressure gas refrigerant discharged from the compressor (21) flows into the switching circuit (25) as a gas refrigerant. Then, the liquid refrigerant and the gas refrigerant are mixed in the switching circuit (25) to become a high-pressure two-phase refrigerant, which flows into the gas-liquid separation unit (4) through the first outdoor communication pipe (11).

The high-pressure two-phase refrigerant flowed into the gas-liquid separation unit (4) passes through the refrigerant flow channel switching circuit (42) to flow into the gas-liquid separator (41) where the high-pressure two-phase refrigerant is separated into a liquid refrigerant and a gas refrigerant. The gas refrigerant flows into the first operation switching unit (5A) through the third intermediate communication pipe (17) and then flows into the first indoor unit (3A) through the second indoor communication pipe (14). In the indoor heat exchanger (71) of the first indoor unit (3A), the refrigerant condenses and dissipates heat to heat the indoor air. The liquid refrigerant condensed in the indoor heat exchanger (71) of the first indoor unit (3A) is confluent with the liquid refrigerant discharged from the gas-liquid separator (41), and goes toward the second and third operation switching units (5B, 5C).

The liquid refrigerant flowed into the second and third operation switching units (5B, 5C) flows into the second and third indoor units (3B, 3C) through the first indoor communication pipe (13), and has its pressure reduced by the indoor expansion valve (72). Then, the liquid refrigerant evaporates in the indoor heat exchanger (71). In the meantime, the indoor air is cooled. The gas refrigerant passed through the indoor heat exchanger (71) passes through the second indoor communication pipe (14), the second and third operation switching units (5B, 5C), and the second intermediate communication pipe (16) to flow into the gas-liquid separation unit (4). This refrigerant passes through the refrigerant flow channel switching circuit (42) and the second outdoor communication pipe (12) of the gas-liquid separation unit (4) to return to the outdoor unit (2). Then, the refrigerant passes through the solenoid valve (29) and is sucked into the compressor (21).

Such circulation of the refrigerants through the refrigerant circuit (20) contributes to a refrigeration cycle in which the first indoor unit (3A) performs a heating operation and the second and third indoor units (3B, 3C) perform a cooling operation.

<Second Cooling Dominant Operation>

Figure 10:
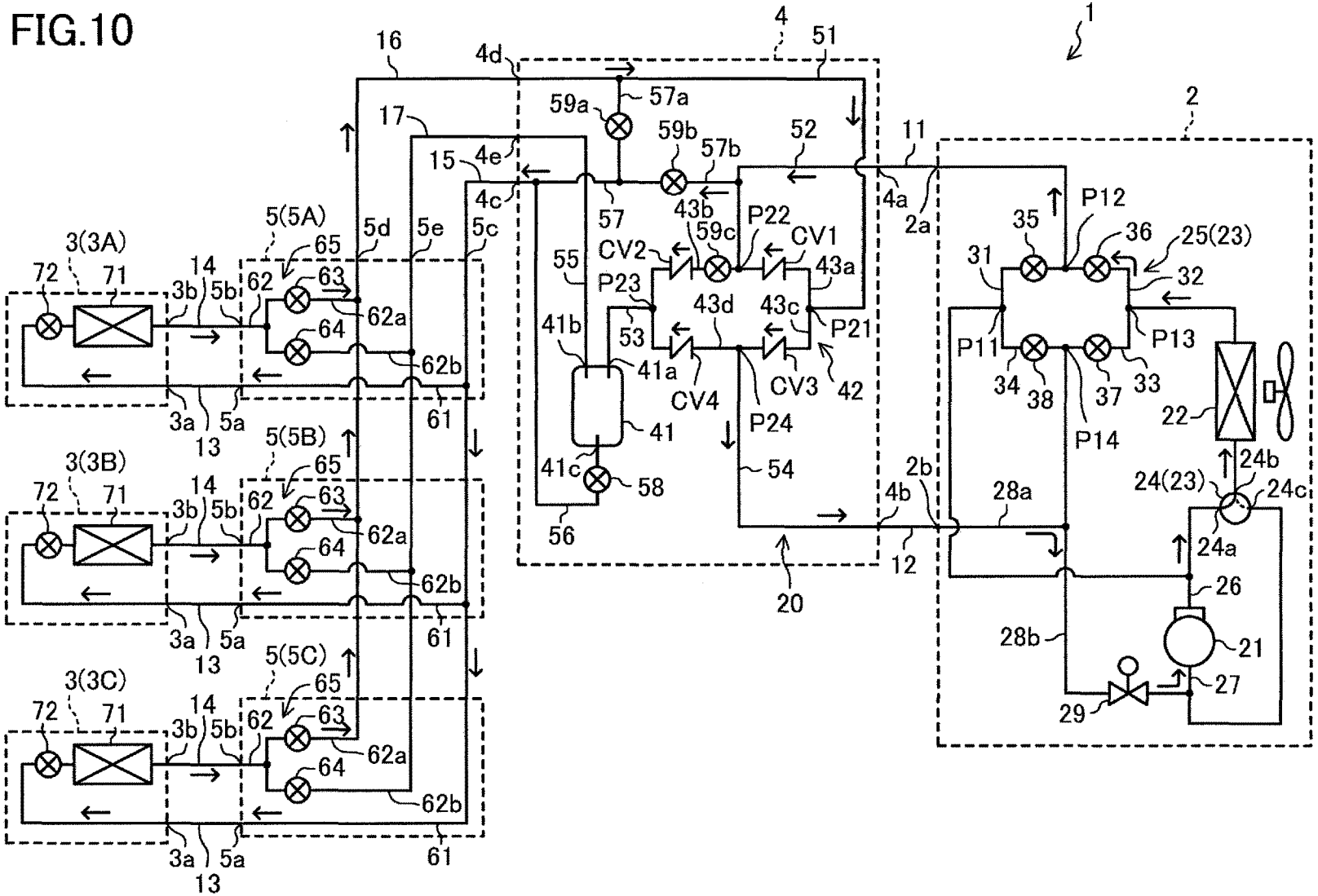
FIG. 10 illustrates the directions in which refrigerants flow through the refrigerant circuit of FIG. 1 during a second cooling dominant operation.

Next, the second cooling dominant operation, which is a full-cooling operation, will be described with reference to FIG. 10.

In this case, in the outdoor unit (2), the three-way valve (24) is set to be the second position, and the second outdoor motor operated valve (36) of the switching circuit (25) is opened, and the first, third and fourth outdoor motor operated valves (35, 37, 38) thereof are closed. The solenoid valve (29) is opened. In the gas-liquid separation unit (4), the third intermediate motor operated valve (59*b*) is opened, and the first, second and fourth intermediate motor operated valves (58, 59*a*, 59*c*) are closed. In the respective operation switching units (5), the first switching valve (63) is opened and the second switching valve (64) is closed. In the indoor units (3), the indoor expansion valve (72) has its degree of opening adjusted.

In this state, the compressor (21) discharges a high-pressure gas refrigerant, which passes through the three-way valve (24) to flow into the outdoor heat exchanger (22) where the high-pressure gas refrigerant condenses to become a liquid refrigerant. This high-pressure liquid refrigerant passes through the switching circuit (25), and then passes through the first outdoor communication pipe (11) to flow into the gas-liquid separation unit (4).

Since the fourth intermediate motor operated valve (59*c*) is closed, the high-pressure liquid refrigerant flowed into the gas-liquid separation unit (4) does not pass through the refrigerant flow channel switching circuit (42) and the gas-liquid separator (41), but passes through the third intermediate motor operated valve (59*b*) to flow out through the first intermediate communication pipe (15) into the respective operation switching units (5).

The high-pressure liquid refrigerant passes through the respective operation switching units (5), and flows into the respective indoor units (3) through the first indoor communication pipe (13). The high-pressure liquid refrigerant has its pressure reduced by the indoor expansion valve (72) of the indoor units (3), and evaporates in the indoor heat exchanger (71). The gas refrigerant evaporated in the indoor heat exchanger (71) passes through the second indoor communication pipe (14), the first branch pipe (62*a*) of the operation switching unit (5), and the second intermediate communication pipe (16) to flow into the gas-liquid separation unit (4). This low-pressure gas refrigerant passes through the refrigerant flow channel switching circuit (42) of the gas-liquid separation unit (4) and the second outdoor communication pipe (12) to return to the outdoor unit (2). The low-pressure gas refrigerant returned to the outdoor unit (2) passes through the solenoid valve (29) and is sucked into the compressor (21).

Such circulation of the refrigerants through the refrigerant circuit (20) contributes to a refrigeration cycle in which every indoor unit (3) performs a cooling operation.

—Advantages of First Embodiment—

According to this embodiment, at the time of upgrading the air conditioner including the refrigerant circuit that comprises the outdoor unit (2) and the plurality of indoor units (3) to perform a cooling/heating switchable refrigeration cycle into the air conditioner including the refrigerant circuit (20) that can perform a refrigeration cycle in which a cooling operation and a heating operation are performed in parallel with each other, the operation switching unit connecting step, the gas-liquid separation unit connecting step, and the pipe connecting step are conducted. Consequently, the air conditioner making a switch from cooling to heating, and vice versa, can be easily upgraded into the cooling/heating free type air conditioner. In addition, preinstalled communication pipes may be used as the outdoor communication pipes (11, 12), the indoor communication pipes (13, 14), and the intermediate communication pipes (15, 16). Only one communication pipe has to be newly added as the intermediate communication pipe (17). As a result, the reinstallation process can be conducted at a lower cost.

«Alternative Embodiments»

The embodiments described above may have the following configurations.

For example, although the switching circuit (25) of the embodiments described above is supposed to have four motor operated valves (35, 36, 37, 38), the switching circuit (25) may also have its configuration modified appropriately. Also, the three-way valve (24) used as an exemplary operation mode switching section in the embodiments described above may be replaced with any other appropriate switching mechanism.

The refrigerant circuit of the embodiments described above may have its configuration modified appropriately, too.

In summary, the present invention may use any other alternative configuration as long as a switching mechanism (23) is provided to change the directions of refrigerants flowing through the communication pipes (11, 12) depending on whether the heating dominant operation is being performed in the first load region where the cooling load is light or the second load region where the cooling load is heavier than in the first load region, in order to allow a low-pressure refrigerant to flow from the indoor units (3) to the outdoor unit (2) through the second communication pipe (12) thicker than the first communication pipe (11) in the second load region.

The above embodiments are merely preferred examples in nature, and are not intended to limit the scope of the present invention, applications thereof, or use thereof.

INDUSTRIAL APPLICABILITY

As can be seen from the foregoing description, the present invention is useful as an air conditioner that includes a plurality of indoor heat exchangers to perform a cooling operation and a heating operation in parallel with each other.

DESCRIPTION OF REFERENCE CHARACTERS

1 Air Conditioner
2 Outdoor Unit
3 Indoor Unit
4 Gas-Liquid Separation Unit
5 Operation Switching Unit
11 First Outdoor Communication Pipe (Outdoor Communication Pipe)
12 Second Outdoor Communication Pipe (Outdoor Communication Pipe)
13 First Indoor Communication Pipe (Indoor Communication Pipe)
14 Second Indoor Communication Pipe (Indoor Communication Pipe)
15 First Intermediate Communication Pipe (Intermediate Communication Pipe)
16 Second Intermediate Communication Pipe (Intermediate Communication Pipe)
17 Third Intermediate Communication Pipe (Intermediate Communication Pipe)
20 Refrigerant Circuit
41 Gas-Liquid Separator
42 Refrigerant Flow Channel Switching Circuit
65 Flow Channel Switching Circuit

The invention claimed is:

1. A reinstallation method for upgrading an air conditioner including a refrigerant circuit that comprises an outdoor unit and a plurality of indoor units to perform a cooling/heating switchable refrigeration cycle into an air conditioner including a refrigerant circuit that is able to perform a refrigeration cycle in which a cooling operation and a heating operation are performed in parallel with each other, the reinstallation method comprising:

an operation switching unit connecting step to connect each of a plurality of operation switching units, which changes directions of a refrigerant flowing through its associated indoor unit in response to a switch from a cooling operation to a heating operation, or vice versa, with the associated indoor unit through two indoor communication pipes that form parts of preinstalled communication piping;

a gas-liquid separation unit connecting step to connect a gas-liquid separation unit, which is disposed separately from the operation switching units and includes a gas-liquid separator and a refrigerant flow channel switching circuit that switches flows of a liquid refrigerant and a gas refrigerant, with the outdoor unit through two outdoor communication pipes that form other parts of the preinstalled communication piping; and a pipe connecting step to connect the operation switching units with the gas-liquid separation unit in parallel with each other through two intermediate communication pipes that form still other parts of the preinstalled communication piping and one intermediate communication pipe newly installed, wherein the gas-liquid separation unit connecting step includes connecting the refrigerant flow channel switching circuit between the gas-liquid separator and the two outdoor communication pipes such that refrigerant flows directly from an outdoor communication pipe into and through the refrigerant flow channel circuit, and then directly from the refrigerant flow channel circuit to the gas-liquid separator.

2. The reinstallation method for an air conditioner of claim 1, comprising:

a step to fill the refrigerant circuit of the upgraded air conditioner with difluoromethane as a refrigerant.

* * * * *